US011500334B2

(12) United States Patent
Heraud et al.

(10) Patent No.: US 11,500,334 B2
(45) Date of Patent: Nov. 15, 2022

(54) TIMEPIECE ESCAPEMENT WITH OPTIMIZED DRAW

(71) Applicant: RICHEMONT INTERNATIONAL SA, Villars-sur-Glâne (CH)

(72) Inventors: Alexis Heraud, Pontarlier (FR); Valentin Molina, Pontarlier (FR)

(73) Assignee: RICHEMONT INTERNATIONAL SA, Villars-sur-Glâne (CH)

( * ) Notice: Subject to any disclaimer, the term of this patent is extended or adjusted under 35 U.S.C. 154(b) by 811 days.

(21) Appl. No.: 16/349,912

(22) PCT Filed: Nov. 16, 2017

(86) PCT No.: PCT/EP2017/079521
§ 371 (c)(1),
(2) Date: May 14, 2019

(87) PCT Pub. No.: WO2018/091619
PCT Pub. Date: May 24, 2018

(65) Prior Publication Data

US 2020/0064777 A1 Feb. 27, 2020

(30) Foreign Application Priority Data

Nov. 17, 2016 (CH) ..... 01522/16

(51) Int. Cl.
*G04B 15/14* (2006.01)
*G04B 15/08* (2006.01)

(52) U.S. Cl.
CPC ..... *G04B 15/14* (2013.01); *G04B 15/08* (2013.01)

(58) Field of Classification Search
CPC ..... G04B 15/14; G04B 15/08
(Continued)

(56) References Cited

U.S. PATENT DOCUMENTS 3,628,327 A 12/1971 Abe
8,757,869 B2 * 6/2014 Kruttli ..... G04B 15/08 368/131
(Continued)

FOREIGN PATENT DOCUMENTS

CH 702689 8/2011
CH 702689 B1 * 8/2011 ..... G04B 15/08
(Continued)

*Primary Examiner* — Edwin A. Leon
*Assistant Examiner* — Kevin Andrew Johnston
(74) *Attorney, Agent, or Firm* — Duane Morris LLP; Gregory M. Lefkowitz; Brandon A. Chan

(57) ABSTRACT

A timepiece escapement comprising: an escapement wheel pivotably mounted about a first axis of rotation and intended to be driven by a power source; a lever pivotably mounted about a second axis of rotation, said lever comprising an entry pallet and an exit pallet, each pallet comprising a rest face arranged to alternately and sequentially lock the escapement wheel, the lever being suitable for transmitting pulses received from the escapement wheel to a regulating member arranged to oscillate, and for releasing the escapement wheel periodically under the control of said regulating member, wherein the rest face of the entry pallet is arranged such that, when it locks a tooth of the escapement wheel, a draw force is generated by the interaction between the rest face and the tooth to apply a torque that tends to retain the lever in the rest position. According to the invention, the rest face is shaped in such a way that the draw angle (Y) at the contact point (C) of said face with a tooth of the escapement wheel is constant or decreases along the release stroke of the entry pallet.

7 Claims, 6 Drawing Sheets

(58) Field of Classification Search
USPC ..... 368/131
See application file for complete search history.

(56) References Cited

U.S. PATENT DOCUMENTS

| | | | | |
|---|---|---|---|---|
| 2012/0307601 | A1 | 12/2012 | Kruttli | |
| 2015/0331391 | A1* | 11/2015 | Dubois | G04B 13/027 29/896.3 |

FOREIGN PATENT DOCUMENTS

| | | | | |
|---|---|---|---|---|
| CH | 708113 | | 12/2014 | |
| DE | 1162290 | | 1/1964 | |
| DE | 1162290 | B * | 1/1964 | G04B 15/08 |
| EP | 2431823 | | 3/2012 | |
| GB | 667885 | | 3/1952 | |
| JP | 2014202604 | | 10/2014 | |

* cited by examiner

TIMEPIECE ESCAPEMENT WITH OPTIMIZED DRAW

CROSS-REFERENCE TO RELATED APPLICATIONS

This application is a § 371 national stage entry of International Application No. PCT/EP2017/079521, filed Nov. 16, 2017, which claims priority of Swiss National Application No. 01522/16, filed Nov. 17, 2016, the entire contents of which are incorporated herein by reference.

TECHNICAL FIELD

The present invention relates to the field of watchmaking. It concerns, more particularly, an escapement with optimized draw.

BACKGROUND ART

A traditional escapement, such as a Swiss lever escapement, an English lever escapement, a Daniels escapement or similar, includes an anchor which blocks an escapement wheel in an intermittent manner, and transmits energy from the going train to the regulating member when the wheel is released. Oscillations of the regulating member, such as a balance wheel and hairspring, actuate the anchor in order to perform this periodic release of the escapement wheel, and to supply an impulsion once more to the regulating member in order to maintain its oscillations.

To this end, the anchor includes at least two pallets, one of which—the entry pallet—being situated upstream in relation to the direction of rotation of the escapement wheel, and the other—the exit pallet—being situated downstream. On each half-oscillation of the regulating member, the pallet which is engaged with the escapement wheel is raised, releasing the escapement wheel and transmitting an impulsion to the regulating member by means of impulsion surfaces situated on the pallets. At the same time, the other pallet is displaced into the trajectory of the teeth of the escapement wheel, and blocks it. The cycle then recommences for the other pallet.

In order to prevent the anchor from being displaced unintentionally, for example in the event of an impact, a "draw" is provided. This draw is conventionally obtained by the angle subtended by the plane of rest of each pallet with respect to the center-to-center line between the anchor and the escapement wheel when the latter is blocked. This angle is selected in such a way that the interaction between the escapement wheel and the anchor applies a torque to the latter, which tends to maintain it in its rest position. In doing so, in order to raise the anchor, the escapement wheel must perform a small angular displacement in the inverse direction of its direction of travel, before being released. The anchor must accordingly work against the going train during the unlocking phase of the pallet.

This work performed by the anchor on the escapement wheel during unlocking is energy-intensive and reduces the efficiency of the escapement. The effect is particularly pronounced with regard to the entry pallet, for which the draw force typically increases during the unlocking phase because of the geometry of the system.

Several attempts have been made to eliminate such a draw generated between the teeth of the escapement wheel and the rest planes of the pallets.

For example, documents EP 2 431 823 and GB 667 885 disclose escapements in which the rest planes of the pallets follow an arc of a circle having its geometrical center on the axis of rotation of the anchor. The draw is thereby eliminated, although a retention force is still necessary in order to prevent the anchor from disengaging unintentionally in the event of a shock. These documents thus propose to supply a retention force of by means of magnets, friction or similar. The utilization of magnets in proximity to the regulating member is not desirable prima facie, and means of producing friction such as elastic strips, for example, which enter into contact with the anchor, are difficult to adjust in order to optimize the force of retention and require supplementary points of attachment on the framework.

Furthermore, document CH702689 describes an improved escapement which nevertheless includes a rest surface 101 that is straight and therefore planar, which also entails a draw angle on the entry pallet which increases during the unlocking phase. This form of pallet is depicted in FIG. 6 and clearly illustrates the end of the rest surface 101. In fact, the impulsion phase begins at the moment at which the tooth of the escapement wheel moves beyond the point indicated by reference 103, thanks to the radius of curvature of this sub-section of the impulsion surface 102.

The object of the present invention is thus, at least partially, to overcome the disadvantages mentioned above.

DISCLOSURE OF THE INVENTION

To this end, the invention relates to an escapement for a timepiece comprising an escapement wheel mounted in a pivotable manner about a first axis of rotation and intended to be driven by a power source, and an anchor mounted in a pivotable manner about a second axis of rotation and arranged to cooperate with a regulating member arranged to produce oscillations with a predetermined periodicity. The anchor comprises an entry pallet and an exit pallet, each pallet comprising a rest surface arranged to block said escapement wheel alternately and sequentially, that is to say one at a time and one after the other.

The anchor is adapted to transmit impulsions received from the escapement wheel to the regulating member and to release said escapement wheel periodically under the control of said regulating member.

In order to maintain the anchor in its blocked position and, in so doing, to avoid any unintentional unlocking, the rest surface of the entry pallet is arranged in such a way that, when it blocks a tooth of the escapement wheel, a draw force is generated by the interaction between said rest surface and said tooth in such a way as to apply a torque which strives to retain the anchor in the rest position. The retention of the anchor at rest is thus assured by the interaction between the pallet and the escapement wheel, and without recourse to other means of retention.

According to the invention, the rest surface exhibits a profile that is configured in such a way that the draw angle ($\gamma$) at the point of contact of said surface with a tooth of the escapement wheel, is constant or decreasing during all or part of the unlocking path of the entry pallet.

Since the draw angle of the entry pallet does not increase during the corresponding unlocking phase, the force and the torque of drawing also does not increase. The oscillations of the regulating member are consequently less disturbed than usual during the unlocking of the entry pallet, which improves the efficiency and the isochronism of said regulating member. Furthermore, this is achieved without any need to provide a pallet having a rest surface in the arc of a circle and additional means of generating a force for the retention of the anchor. As a result, the escapement thus proposed is more efficient than a conventional escapement in terms of the isochronism of the regulating member, and is significantly simpler than the escapements without any draw mentioned above.

For this purpose, the rest surface of the entry pallet may be convex.

Advantageously, the form of said rest surface observes the equation $$90-\gamma-\alpha_{orientation}=\tan^{-1}(R*\sin(\alpha)/\text{Axe}-R*\cos(\alpha))$$

in which:

$-\gamma$ is the draw angle;

$\alpha_{orientation}$ is the angle subtended by a tangent to the rest surface of the entry pallet at its point of contact with the escapement wheel and the center-to-center line between the anchor and the escapement wheel;

$\alpha$ is the angle subtended by a line joining said point of contact and the axis of rotation of the escapement wheel and said center-to-center line;

R is the length of said line joining said point of contact and the axis of rotation of the escapement wheel; and Axe is the length of said center-to-center line.

The value of $\gamma$ may either be substantially constant, or may reduce along at least a part of the unlocking path. The drawing may thus be optimized by selecting the value and/or the progression of $\gamma$ during unlocking.

For example, the value of $\gamma$ may lie in a range between 5° and 20°, preferably between 10° and 15°.

Advantageously, at least one of said pallets may be integral with at least a part of the anchor, which facilitates the manufacture of the anchor and, if the entry pallet is integral with the anchor, ensures that the form of the rest surface of this pallet exhibits the desired form in relation to the axis of rotation of the anchor.

Finally, the invention relates to a watch movement comprising an escapement as defined above, and also to a timepiece comprising such a movement.

BRIEF DESCRIPTION OF THE DRAWINGS

The invention will be more readily appreciated by reading of the following description of an embodiment, given by way of example and made with reference to the drawings, in which.

MODE(S) FOR THE INVENTION

Figure 1:
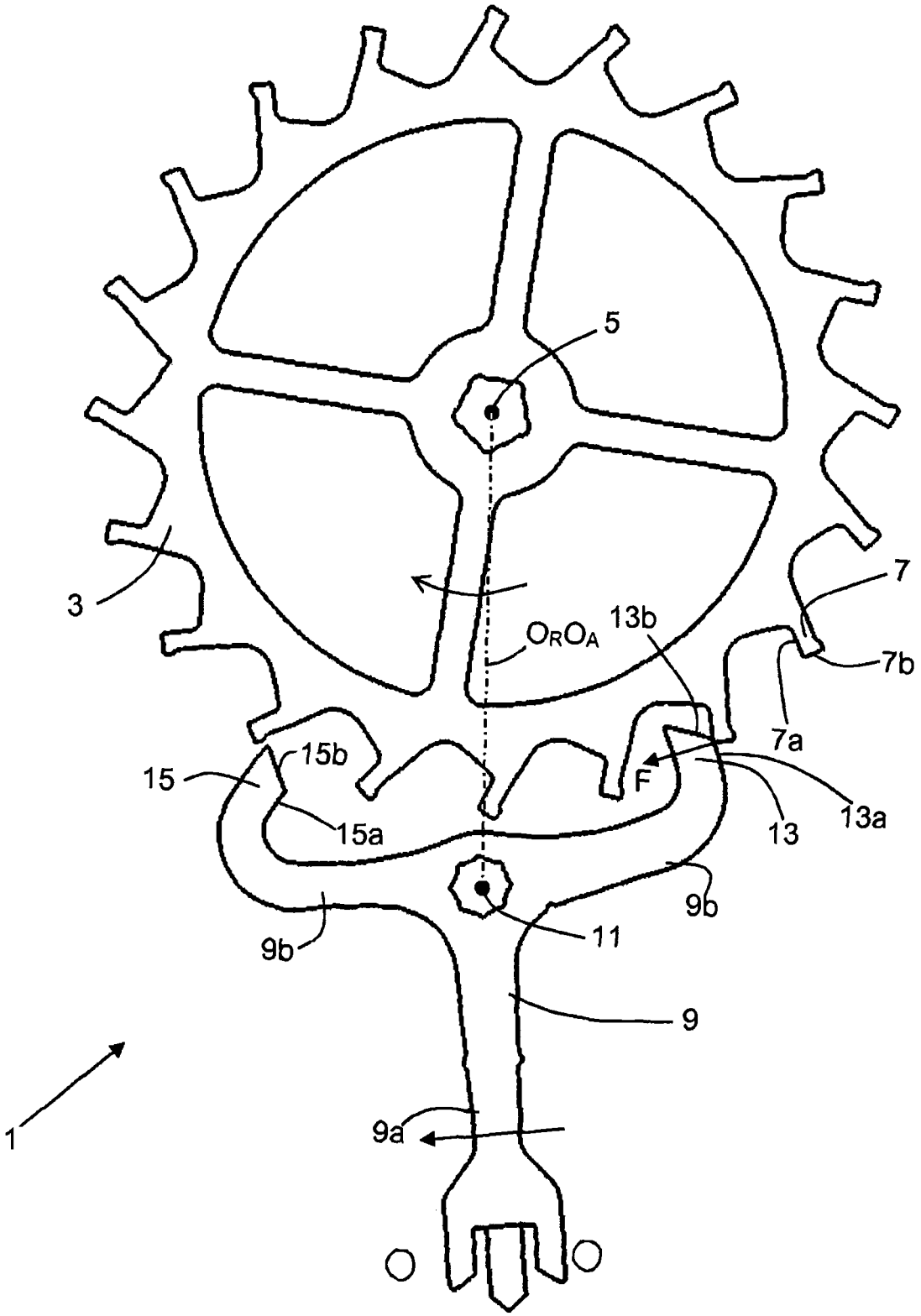
FIG. 1 depicts a schematic plan view of an escapement according to the invention.

FIG. 1 depicts an escapement 1 according to the invention. This escapement 1 embodies the overall form of a Swiss anchor escapement, in which each pallet participates in providing an impulsion to the regulating member.

As generally known, the escapement includes an escapement wheel 3, arranged to be driven by a power source, not depicted here. This power source may be for example a mainspring or an electric motor kinematically linked with the escapement wheel 3 by means of a going train (likewise not depicted).

The escapement wheel 3 is mounted in a pivotable manner on an arbor (not depicted), of which the theoretical axis is indicated by the reference sign 5, and which corresponds to a first axis of rotation. In the variant depicted here, the teeth of the escapement wheel 7 each include a rest surface 7*a*, which interacts with the pallets when the escapement wheel 3 is blocked, and an impulsion surface. However, the invention is applicable to other forms of escapement wheel, for example with pointed teeth (English anchor escapement), or less conventional forms.

The teeth 7 of the escapement wheel 3 interact in a manner known per se with an anchor 9, which pivots about a theoretical axis of rotation 11. In the variant depicted, this theoretical axis 11 coincides with an arbor (not depicted), although an anchor of the "suspended" type as described in document CH708113, or of any other appropriate type, is also possible. This axis 11 corresponds to a second axis of rotation.

The overall form of the depicted anchor 9 is traditional. In this respect, it includes a rod 9*a* extending from the axis of rotation 11 and terminating in a fork 9*c*, which interacts with a regulating member (not depicted) in a known manner which need not be described here in detail. Furthermore, a pair of arms 9*b* extend to either side of the axis of rotation 11 in directions substantially perpendicular to the rod 9*a*, and are terminated by pallets 13, 15. It goes without saying that other less common shapes of anchor may also be utilized within the framework of the invention.

Each of these pallets 13, 15 is arranged to block and to release the escapement wheel periodically, the latter being blocked by one of the pallets 13, 15, and then re-blocked by the other, in sequence.

The pallet 13 depicted on the right in FIG. 1 is the entry pallet, situated upstream in relation to the direction of rotation of the escapement wheel 3 indicated by the arrow, and the pallet 15, situated downstream, is the exit pallet.

Figure 6:
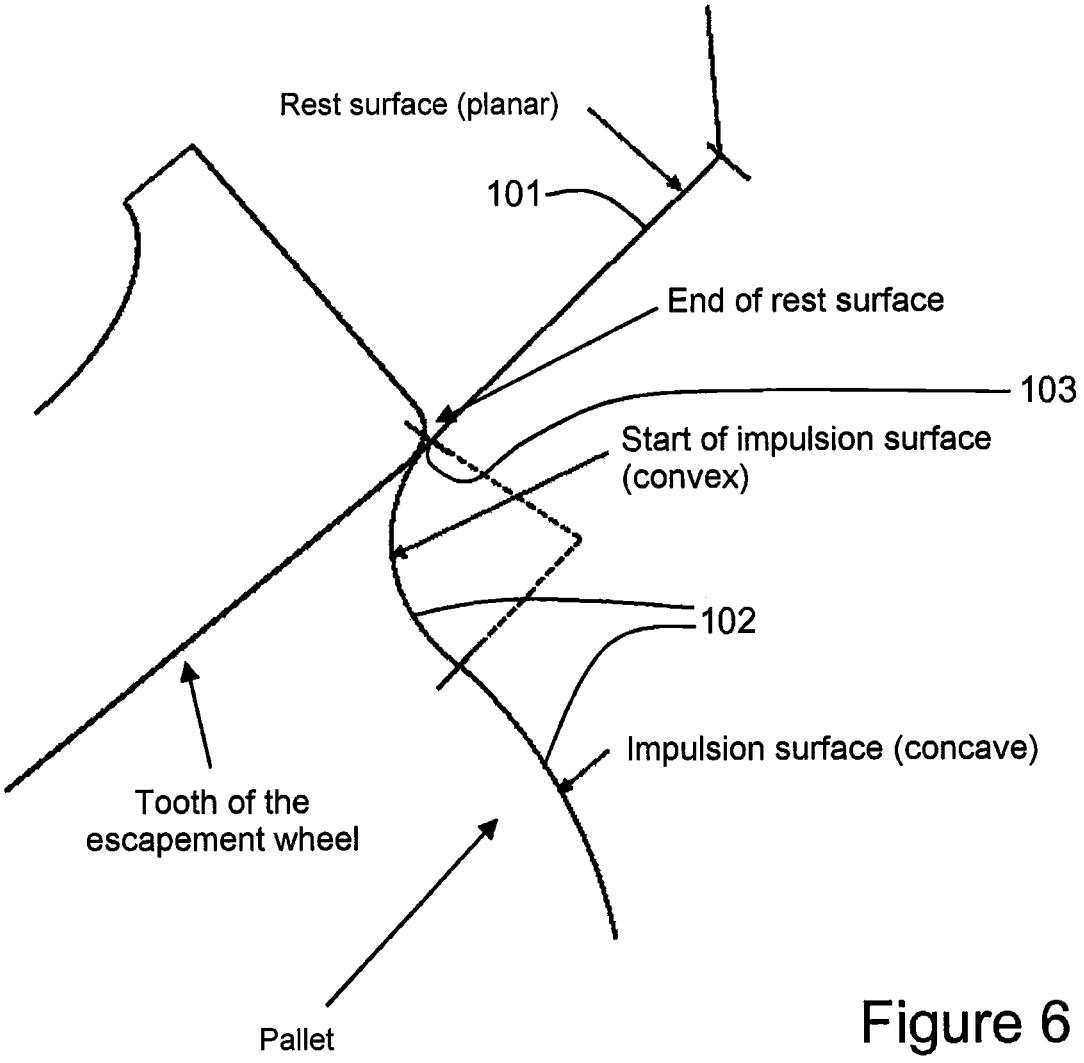
Figure 6 Prior art
FIG. 6 depicts a view of one part of an escapement according to the prior art represented by document CH702689.

In the variant depicted here, the pallets 13, 15 are integral with the anchor 9, although the invention is also applicable to pallets attached to the arms 9*b* in a conventional manner. Each pallet 13, 15 includes, as generally known, a rest surface 13*a* respectively 15*a*, and an impulsion surface 13*b*, 15*b* respectively. The rest surfaces 13*a*, 15*a*, serve to block the escapement wheel 3 during rest phases, and the impulsion surfaces 13*b*, 15*b* cooperate with the teeth 7 in order to transmit an impulsion to the anchor and thus to the regulating member. Even if already implicit in the foregoing, the rest surface 13*a* extends as far as a point where the contact between the pallet 13 and the tooth 7 no longer ensures blocking of the escapement wheel 3, at which point the contact between these elements begins to bring about the transmission of force between the tooth 7 of the escapement wheel 3 and the pallet 13. FIG. 6 clearly depicts this point of transition between these two surfaces.

In a typical escapement of the kind just described, the rest surfaces 13*a*, 15*a* are typically planar, of which the angle is selected in such a way that, during the rest phases, the force F resulting from contact between the rest surface 13*a*, 15*a* comprises a component which tends to keep the pallet 13 or 15, as appropriate, engaged with the escapement wheel 3.

This force F exerts a torque about the axis of rotation 11 of the anchor 9, which strives to keep it engaged with the toothing of the escapement wheel 3, that is to say which strives to cause the anchor to pivot in the anticlockwise direction (according to the orientation of FIG. 1) when the entry pallet 13 is engaged, and in the clockwise direction when the exit pallet 15 is engaged. It should be noted that friction alone, for example between a rest surface in the arc of a circle centered on the axis of rotation of the anchor and the escapement wheel, does not exert such a torque, since no force capable of generating a torque about the axis of rotation of the anchor 9 is exerted between the elements concerned when they are at rest and in the absence of a dynamic force seeking to displace the anchor. In other words, the draw force is applied statically.

In a traditional escapement, however, the angle presented by the rest surface 13*a* of the entry pallet 13 in relation to a tooth 7 of the escapement wheel increases during the unlocking phase, which represents the part of the movement of the anchor between its initial position at rest and the moment at which the tooth 7 performs the transition from the rest surface 13*a* to the impulsion surface 13*b* of the pallet. This results from the fact that, when the anchor 9 pivots about its axis 11, this angle is modified according to the geometry of the anchor and of the entry pallet 13. In essence, the incline of the rest surface 13*a* becomes steeper with respect to the tooth 7. Consequently, the force and the torque that are necessary to overcome the draw increase during the unlocking phase of the entry pallet 13. This is detrimental to the efficiency and to the performance of the escapement and disturbs the oscillations of the regulating member, which impairs the isochronism.

The same disadvantage does not occur at the exit pallet 15, since the angle that its rest surface 15*a* subtends with respect to the tooth 7 reduces during unlocking, since the exit pallet 15 is situated on the other side of the axis of rotation 11 of the anchor 9 with respect to the entry pallet 13.

As a result, the invention relates to the form of the rest surface 13*a* of the entry pallet 13. Since the active surfaces 13*a*, 13*b*, 15*a*, 15*b* of the pallets do not need to be planar, the terminology "surface" is utilized in place of the usual formulation "plane of . . . ".

In particular, the rest surface 13*a* of the entry pallet 13 is formed in such a way that the angle that it subtends with respect to a tooth 7 of the escapement wheel 3 remains constant, or reduces during unlocking.

Figure 2:
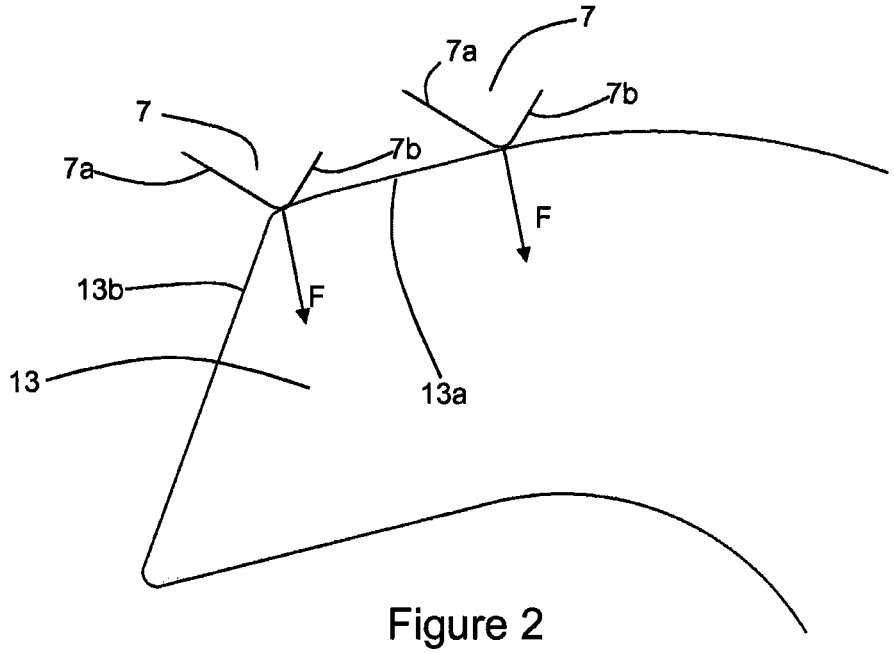
FIG. 2 depicts a schematic plan view of the entry pallet of an escapement according to the invention, on an enlarged scale.

FIG. 2 depicts, on an enlarged scale, the form of an entry pallet 13, of which the rest surface 13*a* exhibits a shape calculated in such a way that the angle of the draw force is constant when it is utilized in an escapement having the geometry of that in FIG. 1.

In FIG. 2, the edge joining the rest surface 7*a* to the impulsion surface 7*b* of a tooth 7 of the escapement wheel 3 is depicted in two positions, one of which—on the right—being at the start of the unlocking phase, and the other—on the left—being just before the end of the unlocking phase and before of the transition to the impulsion phase. The rest surface 13*a* of the pallet 13 is convex and curved in such a way that the direction of the force F resulting from the contact between the tooth 7 and the pallet 13 remains oriented substantially in the same direction when the anchor 9 pivots during the unlocking phase.

Figure 3:
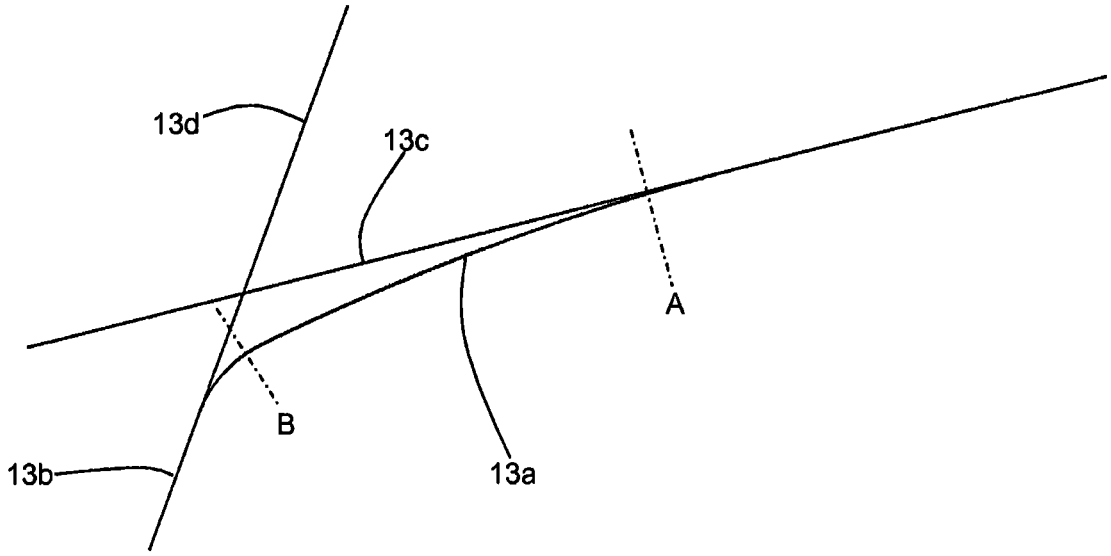
FIG. 3 depicts the form of the rest surface of the entry pallet in FIG. 2 in comparison with straight lines.

FIG. 3 depicts schematically the difference between this curvature and conventional rest planes 13*c* and impulsion planes 13*d*, depicted by straight lines.

This figure clearly shows that, when the profile of the rest surface 13*a* crosses the line A, it departs from the line 13*c* representing a plane of rest B, which represents the start of the transition between the rest surface 13*a* and the impulsion surface 13*b*. At the line B, the profile joins an arc of a circle to which it is tangential, said arc of a circle likewise being tangential to the impulsion surface 13*b*, in order to make this transition continuous. In the variant depicted here, the impulsion surface 13*b* is straight and, as a result, represents a conventional impulsion plane. However, a curved impulsion surface 13*b* is also possible.

Figure 4:
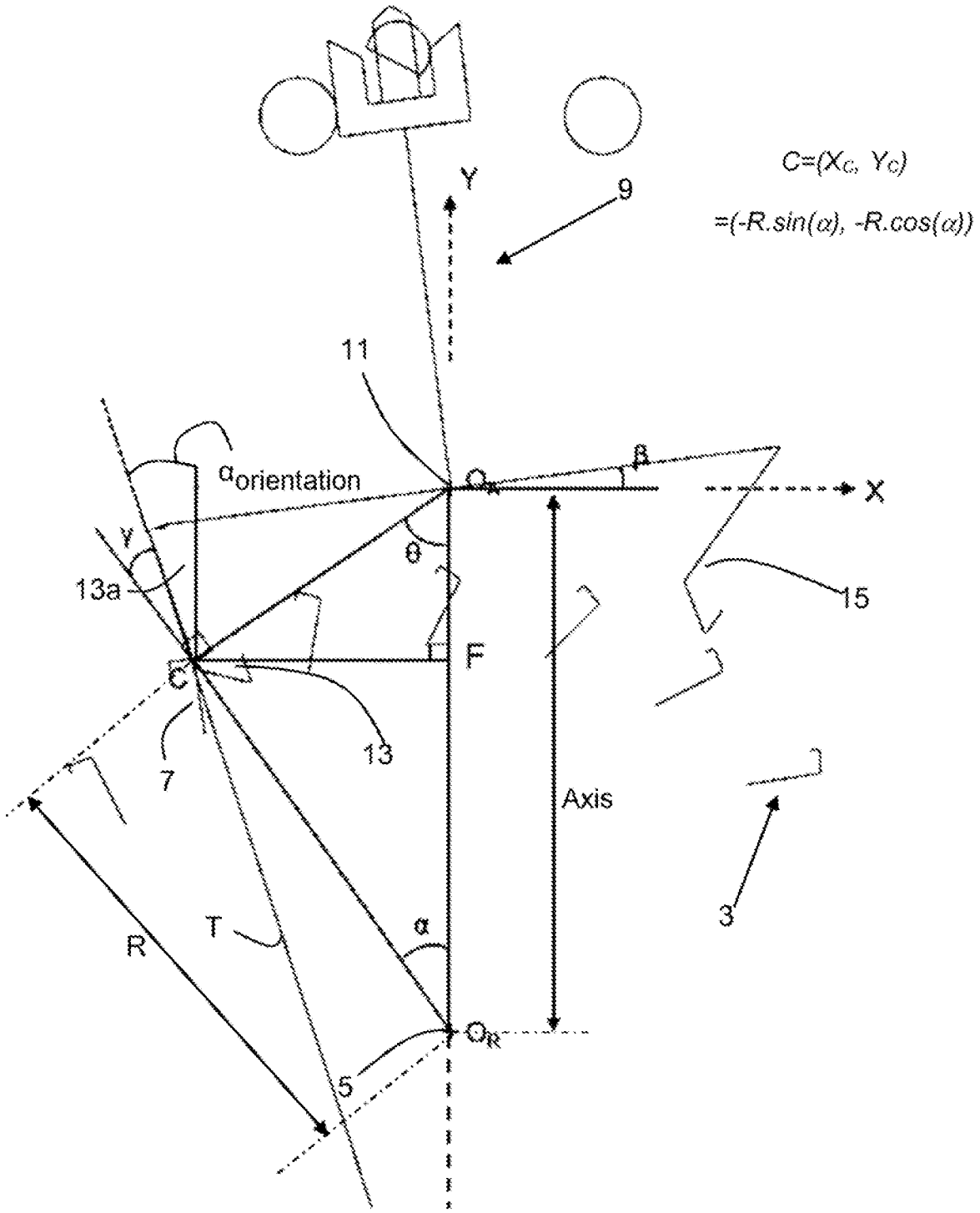
FIG. 4 depicts a useful generic geometric model for calculating the form of the rest surface of the entry pallet in FIG. 2.
Figure 5:
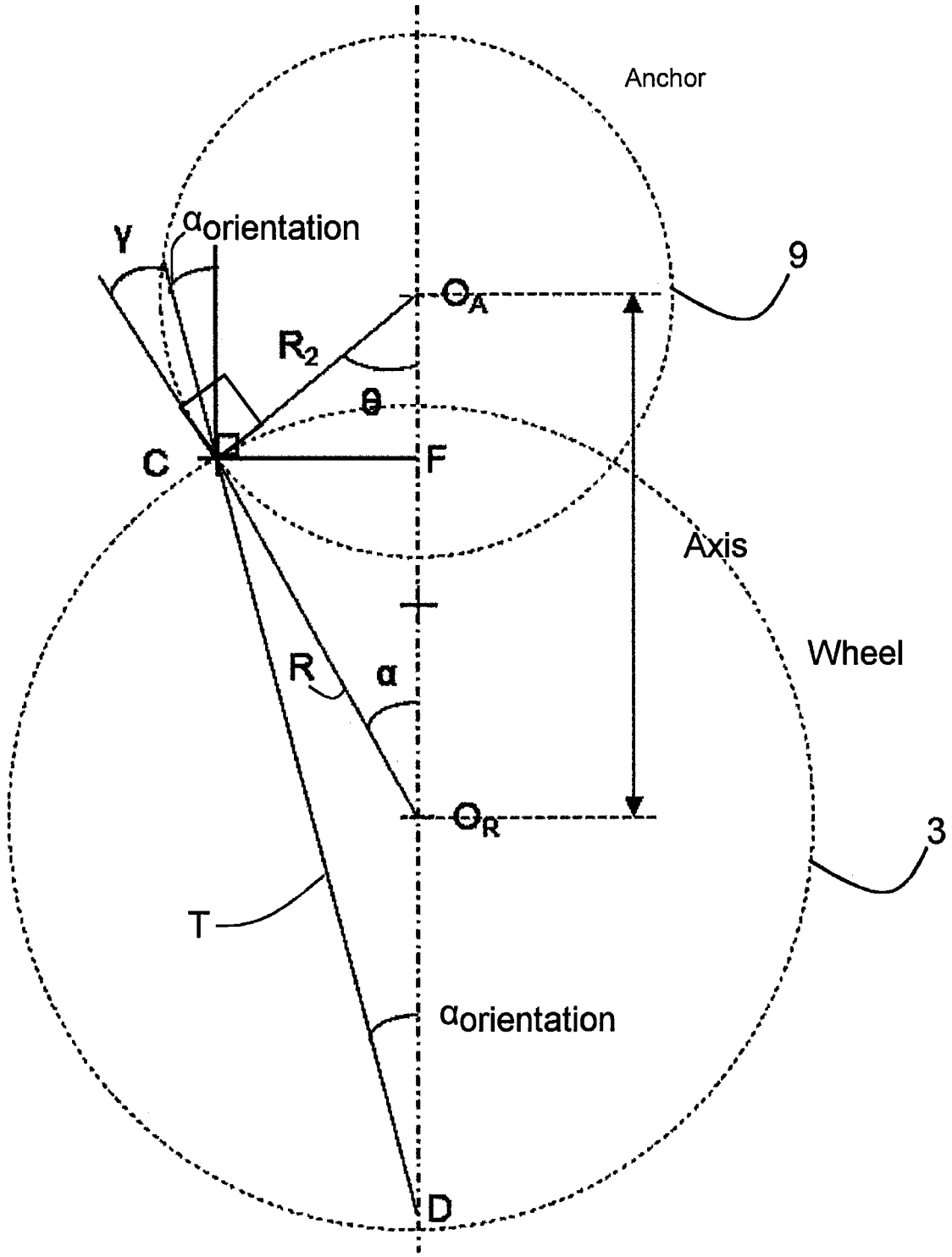
FIG. 5 depicts a simplified view of the geometry illustrated in FIG. 4.

FIGS. 4 and 5 depict schematically a geometric model which makes it possible to calculate the form of the rest surface 13*a* of the entry pallet independently of the form of the anchor. This model schematically represents the interaction between the escapement wheel 3 and the anchor 9. In FIG. 4, the anchor 9 and a number of teeth 7 are depicted schematically, whereas in FIG. 9 the model is depicted minimalistically.

In this model, the center-to-center line $O_RO_A$ between the axis of rotation 5 of the wheel 3 and the axis of rotation 11 of the anchor 9 serves as a reference for the geometry. The point of contact C between a tooth 7 of the escapement wheel 3 and the rest surface 13*a* of the entry pallet 13 traces the profile of said rest surface 13*a* during the unlocking phase, and may be expressed as Cartesian coordinates such as $C=(X_C, Y_C)$. These coordinates $X_C$, $Y_C$ are respectively perpendicular and parallel to the center-to-center line $O_RO_A$.

According to the invention, the angle γ, which depicts the predetermined draw angle, is constant or decreasing during unlocking. This angle γ is measured between, on the one hand, the tangent T to the rest surface 13*a* of the entry pallet at its point of contact C with the escapement wheel 3, and, on the other hand, the normal to the line $O_AC$ joining the axis of rotation of the anchor and the point of contact between the rest surface 13*b* of the entry pallet 13 and a tooth 7 of the escapement wheel 3.

After having selected γ (or its development) beforehand, as well as the geometry of the escapement wheel 3 and of the anchor 9, the geometry may be resolved as follows. It should be noted that, in the notation utilized below, a term such as "CF", "$O_AF$" or similar signifies the length of a straight line joining the points concerned.

In the first place, it is observed that:

$$CF=R.\ \sin(\alpha)$$

in which R is the distance between the axis of rotation $O_R$ of the wheel 3 and the point of contact C between the tooth 7 and the rest surface 13*a*, and α is the angle that $O_RC$ subtends with the center-to-center line $O_RO_A$. Subsequently, $$O_AF=\text{Axe}-R.\ \cos(\alpha)$$

in which Axe is the length of the center-to-center line $O_RO_A$.

For the sake of completeness, it should be noted that the angle θ that the line $O_AC$ subtends with the center-to-center line $O_RO_A$ is expressed as $$\theta=\tan^{-1}(CF/O_AF)$$

The draw angle γ is measured between a line that is orthogonal to $O_AC$ and the tangent T of the rest surface 13*a* at the point C. Consequently $$90°=\gamma+\alpha_{orientation}+\tan^{-1}(X_C/Y_C)$$

in which $\alpha_{orientation}$ is the angle that the tangent of the rest surface 13*a* of the tooth 7 subtends with respect to the center-to-center line $O_AO_R$. This equation may be reorganized as follows $$90°=\gamma+\alpha_{orientation}=\tan^{-1}(X_C/Y_C)$$

By redefining $X_C$ and $Y_C$ as polar coordinates, the following is obtained:

$$90-\gamma-\alpha_{orientation}=\tan^{-1}(R^*\sin(\alpha)/Axe-R^*\cos(\alpha)$$

The profile of the rest surface 13 may thus be traced by calculating the value of $\alpha_{orientation}$ at the point of contact C for each position of the anchor during the unlocking phase, while observing the above relationship. In the case where $\gamma$ varies, a function representing this variation may be utilized in the calculation.

In essence, $\alpha_{orientation}$ may be calculated for a plurality of angular positions of the anchor, and the associated tangents may then be joined in a continuous manner in order to arrive at the desired profile.

The value of $\gamma$ may lie, for example, within a range of values between 5° and 20°, and preferably between 10° and 15°, and may reduce during at least a part of the unlocking phase, while remaining within the interior of this range.

Furthermore, $\gamma$ may also include a tolerance of +/−10%.

The result of this draw is that the anchor 9 may be kept in engagement with a tooth 7 of the escapement wheel, and that the resistance to unlocking of the entry pallet 13 does not increase. Consequently, the oscillations of the regulating member are less disrupted during these unlockings.

Figure 7:
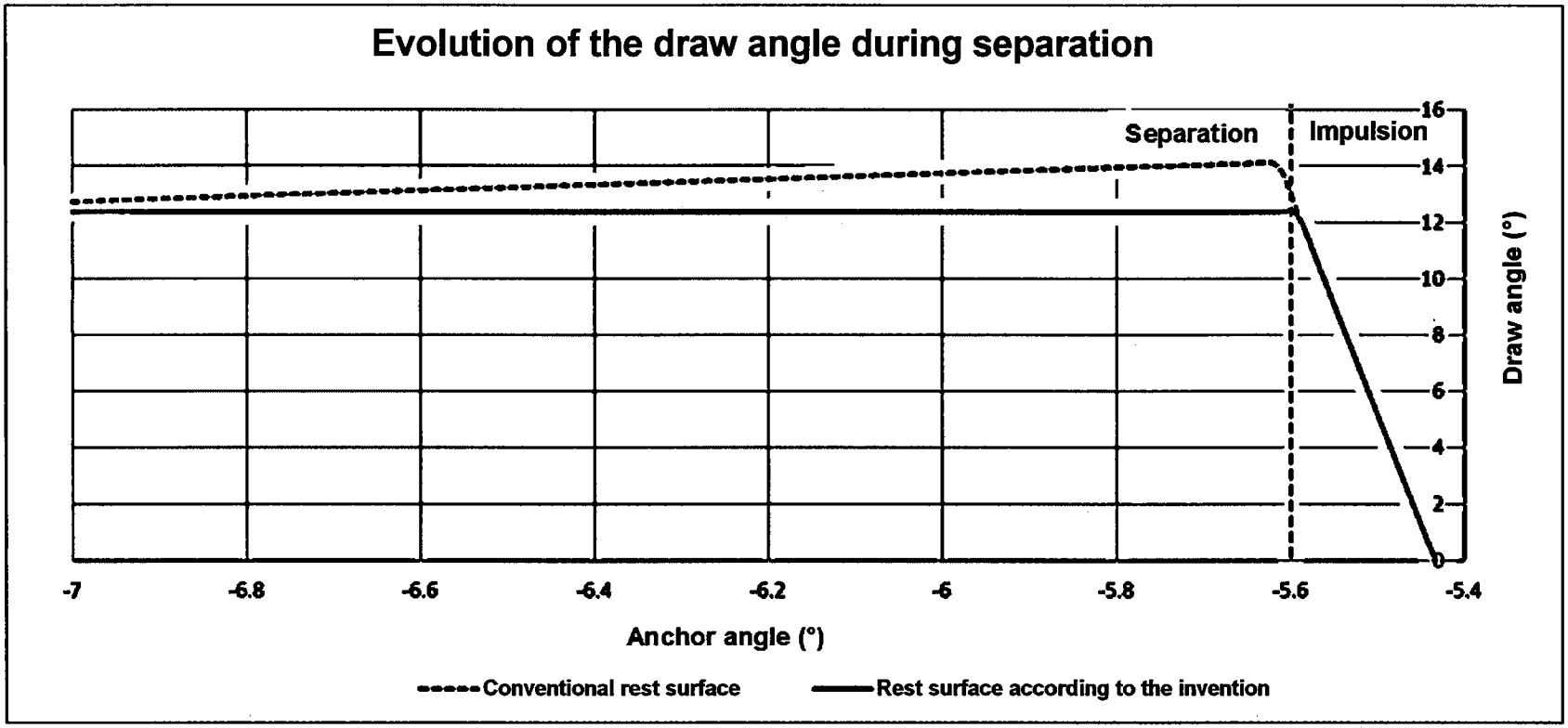
FIG. 7 depicts a graph illustrating the evolution of the draw angle in the unlocking path according to the prior art and according to the invention.

In essence, the graph in FIG. 7 illustrates a comparison between the evolution of the draw angle during the unlocking phase for a pallet of conventional planar form (such as that of document CH702689), shown as a dashed line, and for a pallet exhibiting a rest surface configured according to the invention, shown as a solid line. According to the results of this modeling, it is clear that the draw angle, and thus the resistance to unlocking, no longer increases in the case of a rest surface according to the invention.

The anchor 9 and/or the escapement wheel 3 described above may be manufactured, for example, by micro-machining processes, such as LIGA, 3D printing, masking and engraving from a sheet of material, stereolithography or similar. Appropriate materials may be selected, for example, from among monocrystalline, polycrystalline or amorphous metals (such as steel, the nickel-phosphorus, brass or similar), non-metals such as silicon, its oxide, its nitride or its carbide, alumina in all its forms (for example ruby), diamond (including diamond-like carbon), these non-metallic materials being monocrystalline or polycrystalline. All of these materials may possibly be coated with another hard material and/or anti-friction material, such as diamond-like carbon, alumina or silicon oxide.

Although the invention is described above in conjunction with specific embodiments, additional variants are also conceivable without departing from the scope of the invention as defined by the claims.

The invention claimed is:

1. An escapement for a timepiece comprising:

an escapement wheel mounted in a pivotable manner about a first axis of rotation and intended to be driven by a power source;

an anchor mounted in a pivotable manner about a second axis of rotation, said anchor comprising an entry pallet and an exit pallet, each pallet comprising a rest surface arranged to block said escapement wheel alternately and sequentially, the anchor being adapted to transmit impulsions received from the escapement wheel to a regulating member arranged to produce oscillations, and to release said escapement wheel periodically under the control of said regulating member, in which the rest surface of the entry pallet is arranged in such a way that, when it blocks a tooth of the escapement wheel, a draw force is generated by the interaction between said rest surface and said tooth in such a way as to apply a torque which strives to retain the anchor in its rest position, wherein said rest surface is configured in such a way that the draw angle at the point of contact of said surface with a tooth of the escapement wheel is constant or decreasing during unlocking of the entry pallet, wherein said rest surface is convex, and wherein said rest surface is configured according to the equation:

$$90-\gamma-\alpha_{orientation}=\tan^{-1}(R^*\cos(\alpha)/Axe-R^*\cos(\alpha))$$

in which:

$\gamma$ is the draw angle;

$\alpha_{orientation}$ is the angle between a tangent to the rest surface of the entry pallet at its point of contact with the escapement wheel and the center-to-center line between the anchor and the escapement wheel;

$\alpha$ is the angle between a line joining said point of contact and the axis of rotation of the escapement wheel and said center-to-center line;

R is the length of said line joining said point of contact and the axis of rotation of the escapement wheel; and Axe is the length of said center-to-center line.

2. The escapement as claimed in claim 1, in which $\gamma$ is substantially constant.

3. The escapement as claimed in claim 1, in which $\gamma$ reduces along at least a part of the unlocking path.

4. The escapement as claimed in claim 2, in which the value of $\gamma$ lies in a range between 5° and 20°.

5. The escapement as claimed in claim 1, in which at least one of said pallets is integral with at least a part of the anchor.

6. A timepiece movement comprising an escapement as claimed in claim 1.

7. A timepiece comprising a movement as claimed in claim 6.

* * * * *